United States Patent [19]

Chesemore, James R. et al.

[11] 4,423,300

[45] Dec. 27, 1983

[54] MANUALLY OPERATED DETENTED SWITCH

[75] Inventors: Chesemore, James R., Orange; Frank J. Bruder, Newport Beach, both of Calif.

[73] Assignee: EECO Incorporated, Santa Ana, Calif.

[21] Appl. No.: 352,504

[22] Filed: Feb. 25, 1982

Related U.S. Application Data

[63] Continuation-in-part of Ser. No. 326,795, Dec. 3, 1981, abandoned.

[51] Int. Cl.[3] ..... H01H 3/02

[52] U.S. Cl. ..... 200/339; 200/6 BB; 200/6 C; 200/153 L

[58] Field of Search ..... 200/291, 339, 153 L, 200/153 LA, 246, 6 B, 6 BB, 6 C

[56] References Cited

U.S. PATENT DOCUMENTS 3,878,344 4/1975 Lockard ..... 200/153 L X
3,965,319 6/1976 Lockard ..... 200/6 BB X
4,119,823 10/1978 Matsueda et al. ..... 200/302

FOREIGN PATENT DOCUMENTS 2153266 5/1972 Fed. Rep. of Germany ..... 200/339
1296543 5/1962 France ..... 200/6 C

OTHER PUBLICATIONS

Design News, Apr. 1973, Amp, Inc. advertisement.

*Primary Examiner*—John W. Shepperd
*Assistant Examiner*—Renee S. Kidorf
*Attorney, Agent, or Firm*—Harry R. Lubcke

[57] ABSTRACT

A manually operated switch, typically of DIP size, having a slightly deformable over-center cam rotor journalled in a hollow housing. Symmetrical projections on the rotor move two opposed cantilever springs into and out of electrical contact. The deformation of the rotor provides detent action. Stops are not required. Single wiping action occurs upon closing the contacts. The cantilever springs may be ridged and of unequal length, or not ridged and of equal free length.

13 Claims, 7 Drawing Figures

MANUALLY OPERATED DETENTED SWITCH

This is a continuation-in-part of application, Ser. No. 326,795 filed Dec. 3, 1981, now abandoned.

This invention pertains to a manually operated two-position electric switch.

BACKGROUND OF THE INVENTION

The art has disclosed a manually operated switch having an asymmetic cam, which serves to close two spring contacts or hold them apart, depending upon the position of the cam. An indentation in one spring and one asymmetric projection on the cam coact to provide detenting.

A stop inner ledge in the housing and minor projections on the cam coact to stop rotation of the cam at the extremes of both directions.

The relation of the projections on the cam that coact with the spring contacts is such that two brief periods of sliding occur during the closure of the contacts.

This is U.S. Pat. No. 3,878,344.

Another similar switch has an actuator with two relatively widely spaced projections that press upon ridges formed in each of the two spring contacts to give a combined asymmetric structure. Detent action is provided by nesting one projection within the ridge of the adjacent spring.

Projections on each side of the actuator engage a ledge of the housing to provide stops.

There is no teaching as to sliding contacts.

This is U.S. Pat. No. 4,119,823.

BRIEF SUMMARY OF THE INVENTION

A slightly deformable rotor of insulating material coacts with the inner walls of the housing to provide detent action. No stop is required.

Two symmetrical projections upon the bottom of the rotor essentially midway between the walls of the housing engage the free ends of two opposed cantilever springs to make electrical contact in a single significant wiping action upon the rotor being manually rotated to one side. When rotated to the other side the springs are allowed to separate. An original bias of the springs provides a separating force. Additionally, the second projection moves to provide a positive separation.

An alternate embodiment has symmetrical cantilever springs.

DETAILED DESCRIPTION OF THE PREFERRED EMBODIMENTS

Figure 1:
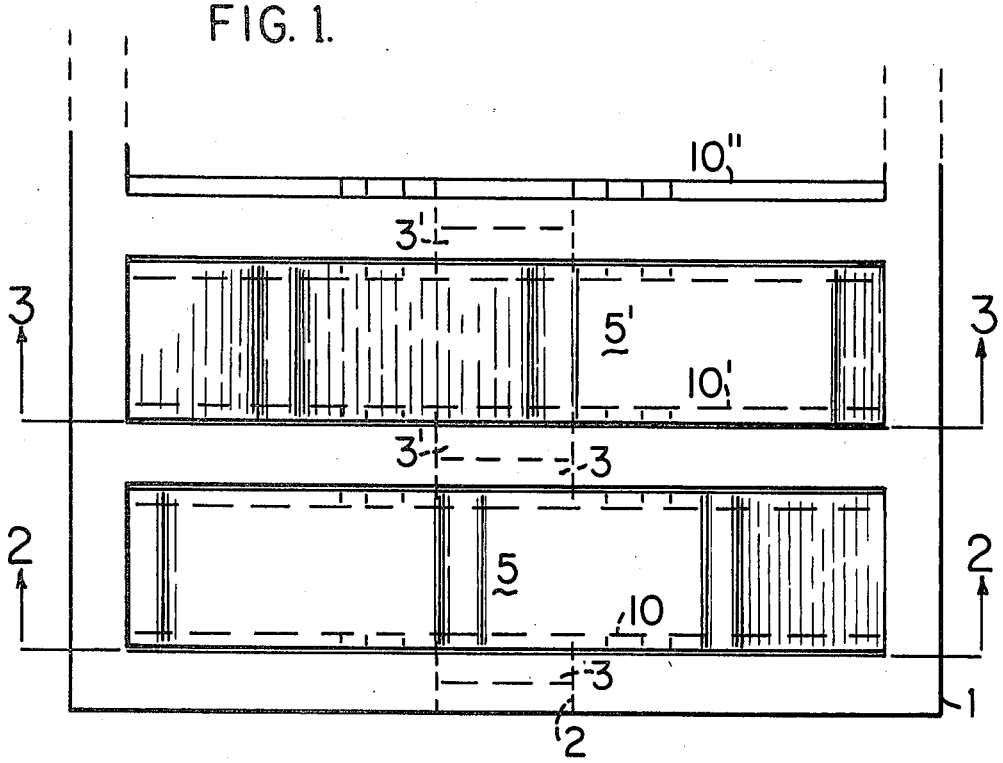
FIG. 1 is a top plan fragmentary view of plural switches in one housing according to the invention.

In FIG. 1, numeral 1 identifies the housing of the switch. This is usually made multiple, as from one to twelve positions, as indicated by the fragmentary plural showing in FIG. 1. A multiple of eight of the dual in-line package, "DIP", format is typical. The switch can be made in any size, and as only one unit. However, the DIP size utilizes a width of 1 centimeter (cm), a length of 2 cm, and a housing height of approximately 0.6 cm, with two lines of eight contact pins separated by 0.7 cm.

The housing is fabricated of a hard dimensionally stable plastic, such as a glass-filled polyester. It has the appearance of a trough with several partitions. Spring contacts, to be later described, are interferenced fitted and cemented in the housing. The active spring portions of each are just above the bottom of each compartment and the connection pins pass through the bottom, vertically, and extend in the DIP format.

An aligned central hole 2 passses through all partitions and the ends of the housing to journal the cylindrical stub shafts 3 and 3' that are integral with each rotor 5, 5', etc.

Alternately, the partitions may be formed with slightly non-parallel sides, being thicker at the bottom, so that the stub shafts are nested in a half-journal. Hole 2 through all of the partitions is then not required.

Figure 2:
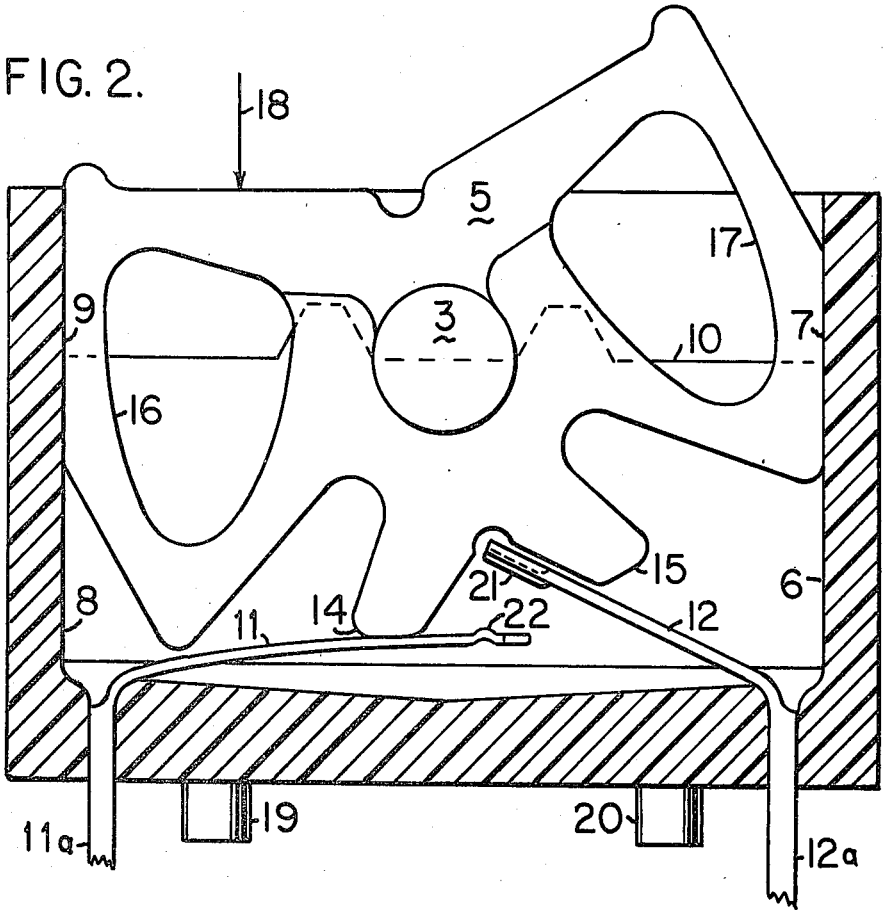
FIG. 2 is a sectional elevation view of the open switch along line 2—2 in FIG. 1.

The inter-relation of the principal elements of the switch is shown in FIG. 2. The intimate contact between inner wall 6 of the housing and edge 7 of rotor 5 is seen at the right. Similarly, the intimate contact between inner wall 8 and edge 9 is seen at the left.

In each instance the lower corner of the edge of the rotor, as 7, is below the center-line of shaft 5. This deforms edge 7 for the over-center cam detent action. Similarly, lower corner of edge 9 is above the center-line of shaft 5, and enhances over-center cam detent action.

The lower cantilever spring 11 is captured in housing 1, as is upper spring 12, each passing through housing 1 close to inner walls 8 and 7, respectively. The bottom extensions **11*a* and 12*a*** of these springs are exterior to the housing and serve as the DIP-configuration external connections to the switch. It has been found that the performance of the spring contacts is superior if the thickness thereof is about one-third that of the bottom extensions; i.e., about 0.11 millimeter (mm) thick.

Copper alloy CDA 688 or CDA 725, or a similar alloy is a suitable material. The contact surfaces are gold plated. The bottom extension is tin or solder plated for ease in soldering. Alternately, a nickel-silver alloy may be used and plating could be eliminated.

Lower spring 11 is pre-tensioned to an upward angle with respect to the inner bottom of housing 1 of not less than approximately three degrees. Similarly, the free position of cantilever arm 12 is twenty-five degrees with respect to the bottom.

In FIG. 2, plural projections 14 and 15 form the lower central part of rotor 5 and mechanically coact with cantilever springs 11 and 12. FIG. 2 shows the electrically "open" position, with the extremities of springs 11 and 12 quite widely separated.

Projection 14 retains spring 11 in the 3° inclined position while the central separation between the projections allows spring 12 to lift to the full extent of the inherent spring bias thereof. Should the bias on either spring be somewhat different than that shown the position and shape of each of the projections retains the springs as required for the proper operation of the switch.

Apertures 16 and 17 in the body of rotor 5 provide the slight deformable property desired of the rotor. The rotor is fabricated of a glass-filled polyester plastic that is less hard than that used for housing 1. With the over-center cam action this flexibility provides a desirable snap action.

Alternately, sides 6 and 8 of housing 1 could be fabricated to be slightly deformable and rotor 5 to be non-deformable.

Rotor 5 assumes the position shown in FIG. 2 upon a force indicated by arrow 18 being exerted upon the upper left part of the rotor, which may be labelled "Off". Classically this would be finger pressure, but where plural switches are present in the DIP format the width of the rotor is only 1.8 mm. Accordingly, a finger-nail, a coffee-stirring stick, or a small screwdriver are preferred manual actuating intermediaries in the hand of the operator.

The deformation structure described gives an audible "snap" when the rotor is actuated. A pressure of approximately six hundred grams is required to operate the switch from "Off" to "On", and vice versa.

Stub shafts 3, 3', etc. are approximately 1 mm in diameter and 0.25 mm long, the latter dimension allowing the shafts to be sprung into central hole 2 and allowing adjacent shafts to colinearly share the same journal in housing 1.

Additionally, the lower part of each interior partition has a slightly increased thickness 10 on each side, say 0.5 mm, to form a pillow block to support the shafts.

Two rows of cylindrical bosses 19 and 20 are disposed about 1 mm from the adjacent DIP terminals. These are approximately 0.5 mm in diameter and 0.5 mm long. These are stand-offs that slightly raise the bottom of housing 1 from the printed-circuit board to which it is typically attached. This allows cleaning after soldering and prevents entrapment of contaminants.

Figure 3:
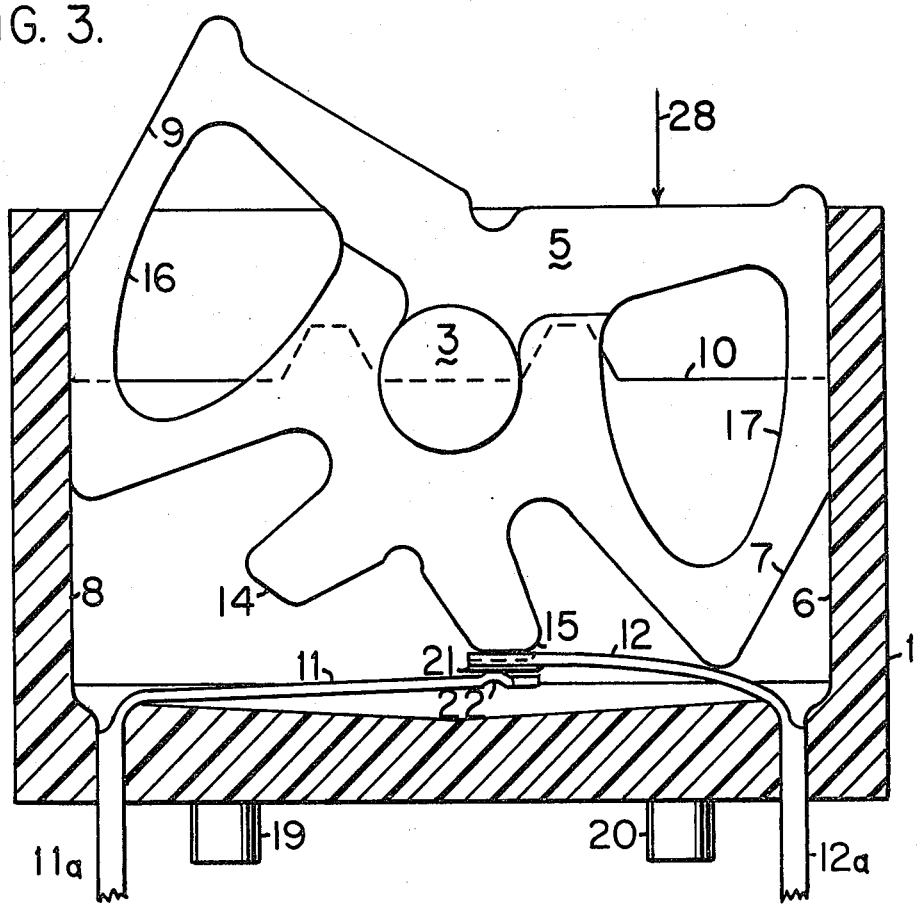
FIG. 3 is a sectional elevational view of another closed switch along line 3—3 in FIG. 1.

FIG. 3 shows the electrically closed, or "On", position of the switch. The identifying numerals are the same as shown in FIG. 2. Rotor 5 has been rotated clockwise about 60° by the application of force 28 on the upper right top of the rotor.

Spring 12 has been pushed significantly downward by projection 15, which in turn has pushed spring 11 downward by a few degrees. Electrical contact is made on ridge 21, which extends a small portion of the length of spring 12 at the free end thereof.

This ridge contacts ridge 22, which extends the width of opposite spring 11.

It will be seen that as spring 12 bears upon spring 11 because of the clockwise rotation of projection 15, the mutually downward action of the springs results in ridge 21 wiping along ridge 22 of spring 11 in the direction away from the free end. A contact-cleaning wipe occurs in the opposite direction upon moving the rotor to "Off". The final contact area is limited to area of the intersection of the two ridges.

With the sides of the rotor securely detented against the inner walls of housing 1 and projection 15 pressing firmly upon the two springs, it is seen that the electrical contact is locked against vibration or the like. The upward bias pressure of spring 11 maintains the contact with the two ridges.

In certain applications it is desirable to retain a low physical profile for the switch as a whole. This can be accomplished by utilizing a modified rotor 50, as shown in FIG. 4.

Figure 4:
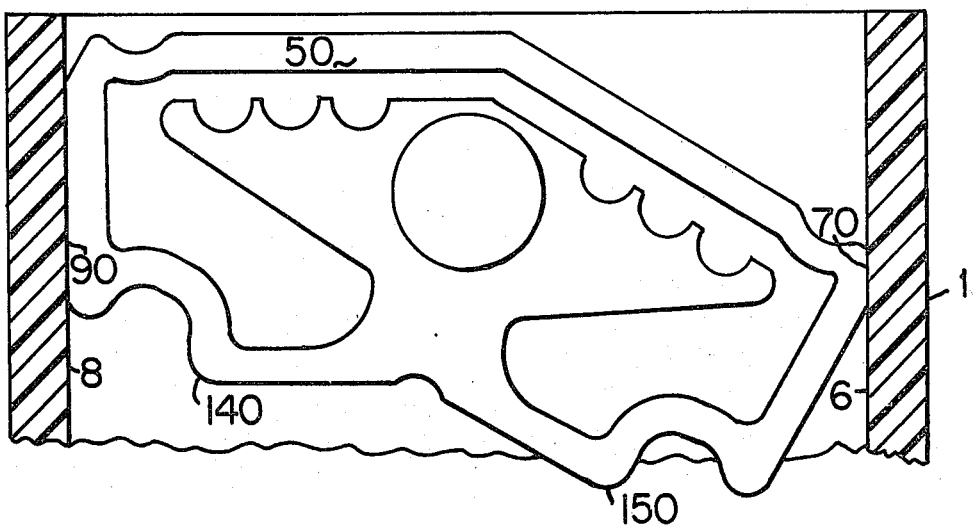
FIG. 4 is an elevation view of an alternate form of rotor with a fragmentary showing of the upper portion of the housing.

The top of the rotor of FIG. 3 is concave upwards, whereas the top of the rotor of FIG. 4 is concave downwards. Rotor 50 thus never extends above housing 1.

Detent action with rotor 50 is accomplished in the same manner as it was with rotor 5. Edge 70, though less extensive than edge 7, coacts with wall 6 as before; as does edge 90 with wall 8.

Lower projections 140 and 150 coact with springs 11 and 12 as before.

Figure 5:
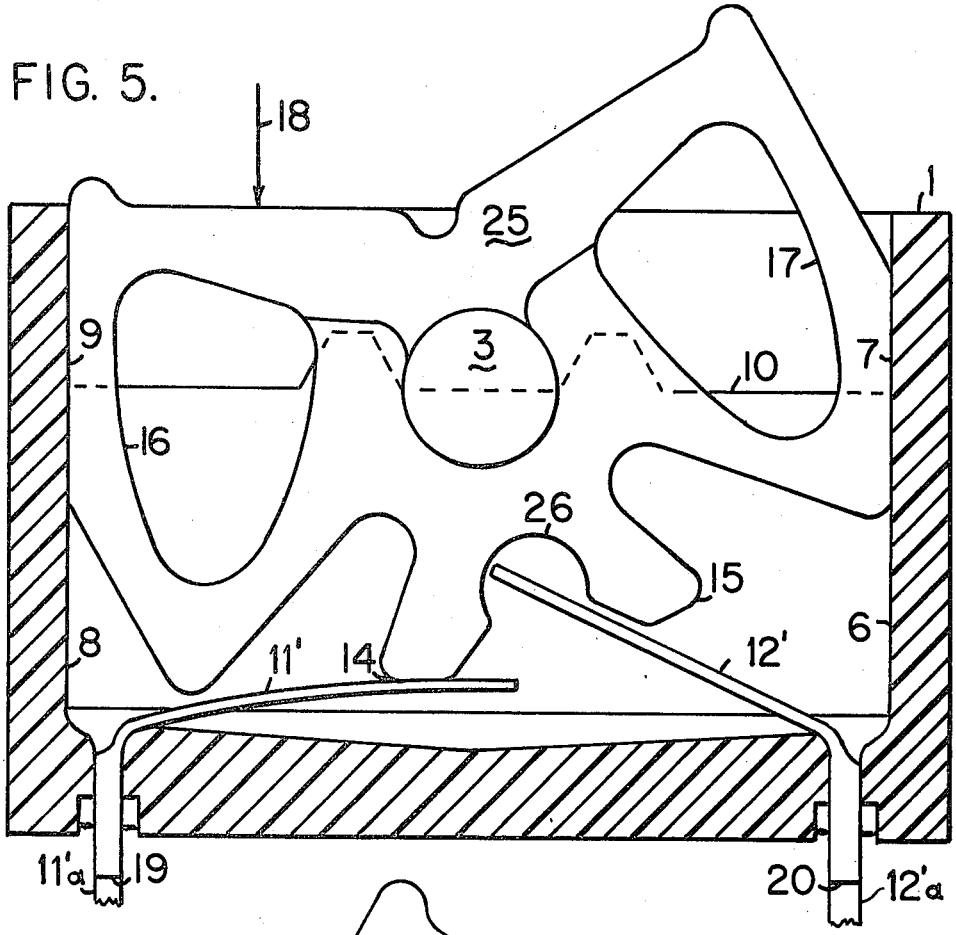
FIG. 5 is a sectional elevation view of an alternate form of the switch in the open position, along line 5—5 in FIG. 7.
Figure 6:
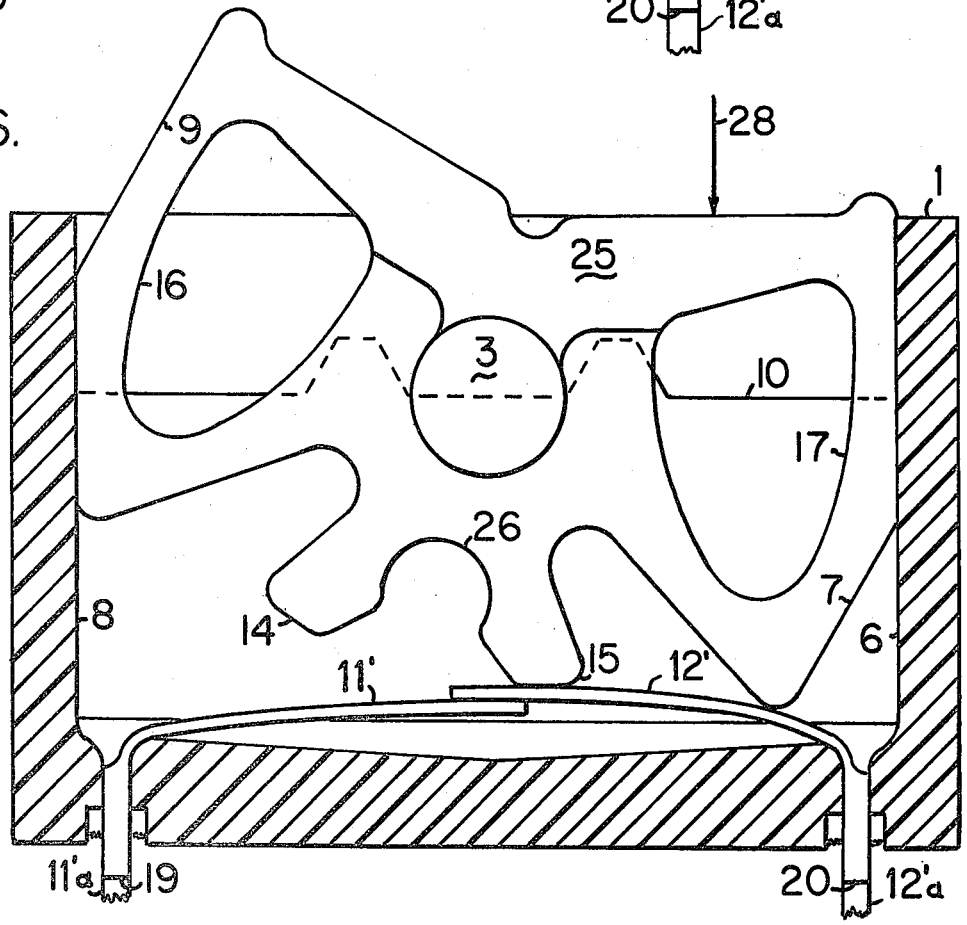
FIG. 6 is a sectional elevation view of the alternate form of the switch in the closed position.

The embodiment of FIGS. 5 and 6 is totally symmetrical about a central vertical plane, whereas the prior embodiment(s) have had an asymmetrical contact spring structure. The symmetrical embodiment promotes ease and economy in fabrication.

Rotor 25 of FIG. 5 is the same as rotor 5 of FIG. 2, except that circular cut-out 26 between projections 14 and 15 is about three times larger than before. This accommodates symmetrical cantilever springs 11' and 12' as will be noted by the position of spring 12' in FIG. 5. Instead of being of unequal length, as springs 11 and 12, springs 11' and 12' are of equal length. The whole of the latter springs are of equal size and shape; thus only one spring need be manufactured.

In FIG. 5, spring 12' has been bent in the last manufacturing step to be at a greater angle to its stem **12*a'* than spring 11'. This "shingles" spring 12' over spring 11'. See FIG. 6**.

In the detent position of rotor 25 in FIG. 5, projection 15 allows full opening of the contacts. Projection 14 holds spring 11' down.

As the rotor is rotated clockwise to the detent position shown in FIG. 6, spring 12' is urged downward by projection 15 and spring 11' is released by projection 14. Spring 12' is firmly pressed down upon spring 11' to give the electrically closed condition for the switch circuit.

The configuration shown in FIGS. 5 and 6 provides a closed circuit when rotor 25 is down at the right. By merely interchanging the positions of springs 11' and 12', so that the overlay is opposite, an open circuit is provided when the rotor is down at the right.

Figure 7:
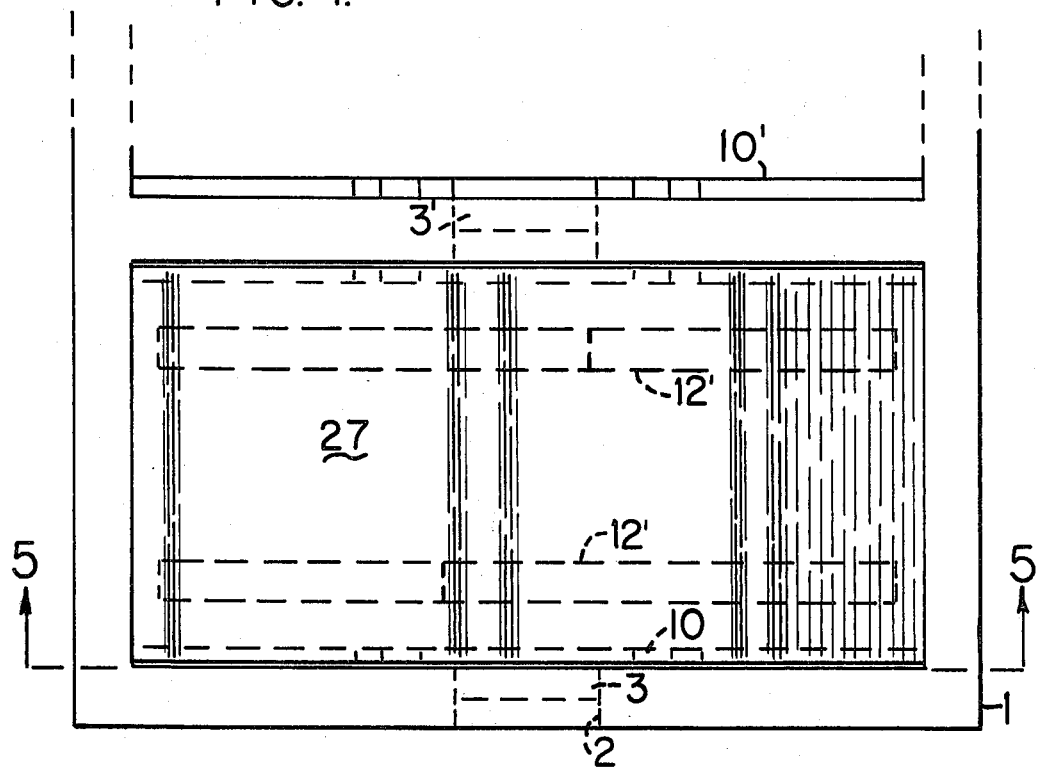
FIG. 7 is a top plan fragmentary view of plural switches in one housing having a common rotor.

In manufacture, plural switch sections, as shown at 10 and 10' in FIG. 7 (and in FIG. 1), can be assembled to give all sections electrically closed when the rotor is down at the right. This is the "Z" configuration, as known in the trade.

If plural switch sections are assembled with the springs overlaid at the right in one section and at the left in another section, then one section has closed contacts with a given position of the rotor and another section has open contacts. This is the known "C" configuration. Compare the overlay of springs 12' in FIG. 7.

It will be understood that plural adjacent rotors, such as 5 and 5' in FIG. 1 and 25 and 25' of the alternate embodiment can be fabricated in one piece, as rotor 27 in FIG. 7, which replaces rotors 25 and 25'. In this way two or more poles of the switching circuit can be actuated at once.

With such a multiple rotor and the selection of how the springs are formed and inserted in switch body 1, it is seen that many desired switching patterns can be actuated by manipulating only one rotor.

We claim:

1. An electro-mechanical switch, comprising;

(a) a hollow housing (1), (b) a rotor (5) centrally journalled within said housing, (c) a first cantilever spring contact (12) depressible by said rotor, (d) a second cantilever spring contact (11) depressible by said first spring contact, (e) plural, slight deformable rectilinear sides (7,7',9,9') upon said rotor dimensioned in relation to said hollow housing to exclusively force said rotor to occupy plural specific rotational positions, and (f) plural essentially symmetrical mutually-diverging projections (14,15) upon said rotor, one said projection (15) to force said spring contacts into mutual mechanical and electrical contact upon said rotor occupying one said specific rotational position, and another said projection (14) to force said spring contacts out of mutual mechanical and electrical contact upon said rotor occupying another said specific rotational position.

2. The switch of claim 1, in which;

(a) said rotor is formed with hollow areas (16,17) adjacent to said rectilinear sides, and (b) said rectilinear sides are deformed by said hollow housing to force said rotor to occupy plural specific rotational positions.

3. The switch of claim 1, in which;

(a) said first cantilever spring contact has a longitudinal ridge on the side adjacent to said second cantilever spring contact, and (b) said second cantilever spring contact has a transverse ridge on the side adjacent to said first cantilever spring contact, whereby the mutual mechanical and electrical contact between the contacts is a limited area.

4. The switch of claim 1, in which;

(a) the coactive mechanical relationship between said projections and said cantilever spring contacts is such that said contacts engage with a single mechanical wiping action.

5. The switch of claim 1, in which;

(a) said first and second cantilever spring contacts are oppositely disposed, one to the other, with the free ends thereof overlapping upon being pressed together by one of said essentially symmetrical mutually-diverging projections.

6. The switch of claim 1, in which;

(a) the top of said rotor is concave upward, with a central depression and raised portions at each extremity.

7. The switch of claim 1, in which;

(a) the top of said rotor is concave downward, and (b) said rotor is disposed within said housing to be completely within said housing regardless of the rotational position of said rotor.

8. The switch of claim 1, in which;

(a) said first and second cantilever spring contacts (12',11') are each of equal length and flat at the adjacent extremities thereof.

9. The switch of claim 1, in which;

(a) said first cantilever spring contact (12') overlays said second cantilever spring contact (11').

10. The switch of claim 1, in which;

(a) said first cantilever spring contact (12') can be on either side of the housing.

11. The switch of claim 1, which includes;

(a) plural housing sections (10,10'), each having a rotor (25,25'), and (b) first (12') and second (11') cantilever spring contacts.

12. The switch of claim 1, in which;

(a) there are plural sets of first and second cantilever spring contacts in said housing, and (b) said rotor bears upon said plural sets of contacts.

13. The switch of claim 12, in which;

(a) said first cantilever springs (12') can be on either side of the housing.

* * * * *